US008657638B1

(12) United States Patent
Gonring

(10) Patent No.: US 8,657,638 B1
(45) Date of Patent: Feb. 25, 2014

(54) SYSTEMS AND METHODS FOR DETERMINING OIL LEVEL IN OUTBOARD MOTORS

(75) Inventor: Steven J. Gonring, Slinger, WI (US)

(73) Assignee: Brunswick Corporation, Lake Forest, IL (US)

( * ) Notice: Subject to any disclaimer, the term of this patent is extended or adjusted under 35 U.S.C. 154(b) by 175 days.

(21) Appl. No.: 13/313,930

(22) Filed: Dec. 7, 2011

(51) Int. Cl.
*B63H 21/38* (2006.01)

(52) U.S. Cl.
USPC ..... 440/88 L; 123/196 W

(58) Field of Classification Search
USPC ..... 440/88 L, 88 R; 701/21, 1, 24; 73/291, 73/295; 123/196 R, 196 S, 196 W
See application file for complete search history.

(56) References Cited

U.S. PATENT DOCUMENTS 3,412,610 A 11/1968 Prussin
3,792,456 A 2/1974 Hill
4,110,740 A 8/1978 Akita et al.
4,903,653 A 2/1990 Slattery
4,921,071 A 5/1990 Lonnborg et al.
4,940,965 A 7/1990 Umehara
5,072,615 A * 12/1991 Nawrocki ..... 73/291
6,227,921 B1 5/2001 Feehan
6,237,411 B1 5/2001 Schimmel et al.
6,578,415 B2 6/2003 Schimmel et al.
7,118,435 B2 * 10/2006 Takahashi et al. ..... 440/88 L
7,571,032 B2 8/2009 Kanno et al.

* cited by examiner

*Primary Examiner* — Lars A Olson

(74) *Attorney, Agent, or Firm* — Andrus Intellectual Property Law, LLP

(57) ABSTRACT

In systems and methods for determining oil level in a marine outboard motor having an internal combustion engine, a control circuit determines whether oil has drained back into a sump from the internal combustion engine. An oil sensor senses an oil level in the sump. The control circuit calculates a characteristic of the actual oil level of the outboard motor based upon the oil level after the oil has drained back into the sump and based upon a trim position of the outboard motor.

15 Claims, 3 Drawing Sheets

SYSTEMS AND METHODS FOR DETERMINING OIL LEVEL IN OUTBOARD MOTORS

FIELD

The present disclosure relates to outboard motors.

BACKGROUND

U.S. Pat. No. 4,903,653, which is incorporated herein by reference in its entirety, discloses a marine outboard drive unit that includes a powerhead having a two-cycle internal combustion engine, a lower depending driveshaft housing extending downwardly from the powerhead and having a lower submerged propeller, and an oil tank mounted adjacent the driveshaft housing below the powerhead. The oil tank has a U-shape and extends partially around and conforms to the driveshaft housing and is mounted in the space between the driveshaft housing and a trim cover which extends downwardly from the engine cowl. Particular mounting structure, rattle-reducing structure, and visual oil level monitoring structure is provided.

U.S. Pat. No. 4,921,071, which is incorporated herein by reference in its entirety, discloses a transparent container mounted to the inner transom wall of a boat and connected to the oil passages in a stern drive unit. The container is provided with a removable cap having a one-way valve of the Vernay type therein. The valve prevents outward leakage of lubricant fluid from the container, but permits inward passage of air so that, during engine and drive unit cooling, lubricant can be sucked back into the system through the drive housings. The cap may be provided with a lubricant level warning device which extends downwardly into the container.

U.S. Pat. No. 6,227,921, which is incorporated herein by reference in its entirety, discloses a marine propulsion device, such as an outboard motor, provided with an oil measuring gage or dipstick which is accessible by the operator of the outboard motor without having to remove the cowl from the device. A first end of the dipstick extends through a dipstick tube into the oil sump of the outboard motor and a second end of the dipstick is connected to a handle that extends through the cowl. The handle is shaped to be retained in a hole formed through the cowl in such a way that the hole is sealed by a portion of the handle to prevent water from passing into the engine compartment through the cowl. A dampening mechanism is provided to dampen vibrations that would otherwise be transmitted between the handle and the dipstick.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter. In some examples, systems for determining oil level in outboard motors comprise an internal combustion engine, a control circuit that determines whether oil has drained into a sump from the internal combustion engine, and an oil sensor sensing the oil level in the sump. The control circuit can calculate a characteristic of the oil level based upon the sensed oil level after the oil has drained back into the sump and based upon a trim position of the outboard motor. In other examples, methods of determining oil level in a marine outboard motor include determining, with a control circuit, that oil has drained into a sump from an internal combustion engine in the outboard motor; sensing an oil level in the sump once the oil has drained back into the sump; and calculating, with the control circuit, a characteristic of the oil level of the outboard motor based upon the sensed oil level and a trim position of the outboard motor.

BRIEF DESCRIPTION OF THE DRAWINGS

Embodiments of systems and methods for determining oil level in marine outboard motors are described with reference to the following figures. The same numbers are used throughout the figures to reference like features and components.

DETAILED DESCRIPTION OF THE DRAWINGS

In the present disclosure, certain terms have been used for brevity, clearness and understanding. No unnecessary limitations are to be inferred therefrom beyond the requirement of the prior art because such terms are used for descriptive purposes only and are intended to be broadly construed. Various equivalents, alternatives and modifications are possible within the scope of the appended claims.

Figure 1:
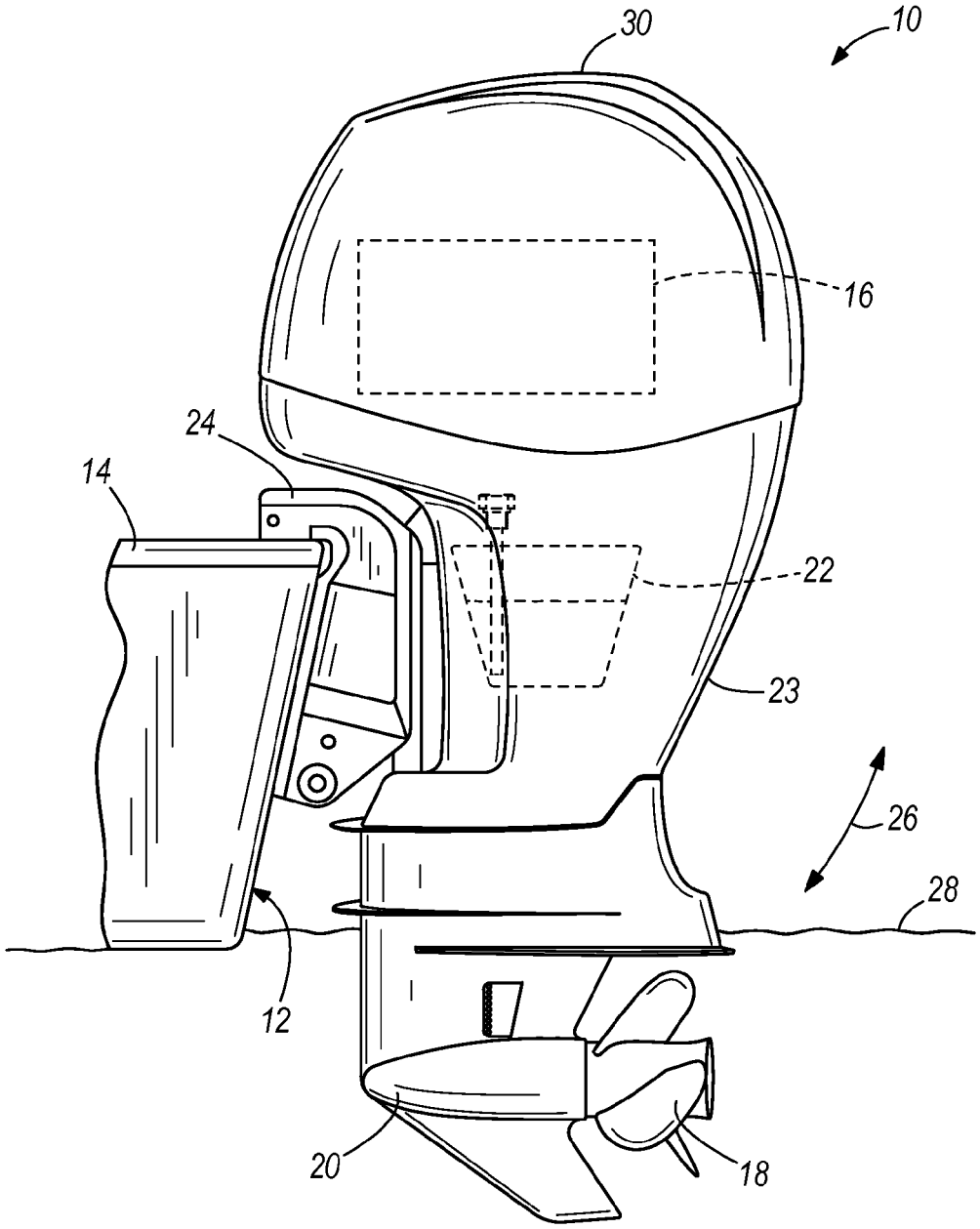
FIG. 1 depicts an outboard motor for a marine vessel.

FIG. 1 depicts an exemplary outboard motor 10 mounted on the stern 12 of a marine vessel 14. The type and configuration of marine vessel and outboard motor can vary from that which is shown. The outboard motor 10 has an internal combustion engine 16 that causes rotation of a conventional propeller 18 extending from a propeller housing 20. A sump 22 is located in a driveshaft housing 23 beneath the internal combustion engine 16 and holds oil that is circulated to and from the internal combustion engine 16. The size, structure and orientation of the sump 22 can vary from that shown. The outboard motor 10 is pivotally connected to the stern 12 of the marine vessel 14 by a connecting bracket 24, which facilitates trimming movement of the outboard motor 10 along the direction shown by trim arrows 26 to thereby change the angle of the propeller 18 with respect to the waterline 28, as is conventional. Trimming of the outboard motor 10 is also conventionally employed during maintenance, storage and/or transportation of the marine vessel 14 over land.

Manufacturers of outboard motors typically recommend that the operator of the marine vessel 14 check the oil level in the sump 22 before each use of the outboard motor 10 and maintain a proper amount of oil in the sump 22 to prevent damage to the internal combustion engine 16. To facilitate this task, many outboard motors 10 include a manually-operated dipstick that extends out of the sump 22. Manual withdrawal of the dipstick from the sump 22 and visual inspection of the oil level residing on the shaft of the dipstick allows the operator to visually check the oil level in the sump 22. Most dipsticks have a handle that resides under the cowl 30 of the outboard motor 10. As such, in order to check the oil level in the sump 22 it is necessary for the operator to first remove the cowl 30, then manually grasp the handle and withdraw the dipstick from the sump 22, visually inspect the dipstick, manually replace the dipstick in the sump, and then replace the cowl 30 on the outboard motor 10. This is a time consuming process and can be a major inconvenience to the operator. As an alternative to this type of arrangement, some outboard motors are equipped with electronic sensors such as float switches for electronically monitoring oil level in the sump 22. Other outboard motors have transparent viewing windows in the side of the driveshaft housing 23 to allow for visual inspection of the oil level in the sump 22.

Through research and experimentation, the present inventor has realized that prior art arrangements for measuring oil level in the sump 22, such as those described herein above, do not account for the trim position of the outboard motor 10 at the time of measurement, and also do not account for whether or not oil currently resides in the internal combustion engine 16 and has not yet drained back into the sump 22. The inventor has found that these two factors, especially when taken together, can greatly affect the oil level in the sump 22. If these two factors are not properly considered at the time of measurement, the inventor has found that such measurement can be inaccurate and can potentially result in damage to the outboard motor 10 and possibly unsafe operating conditions for the operator.

Figure 2:
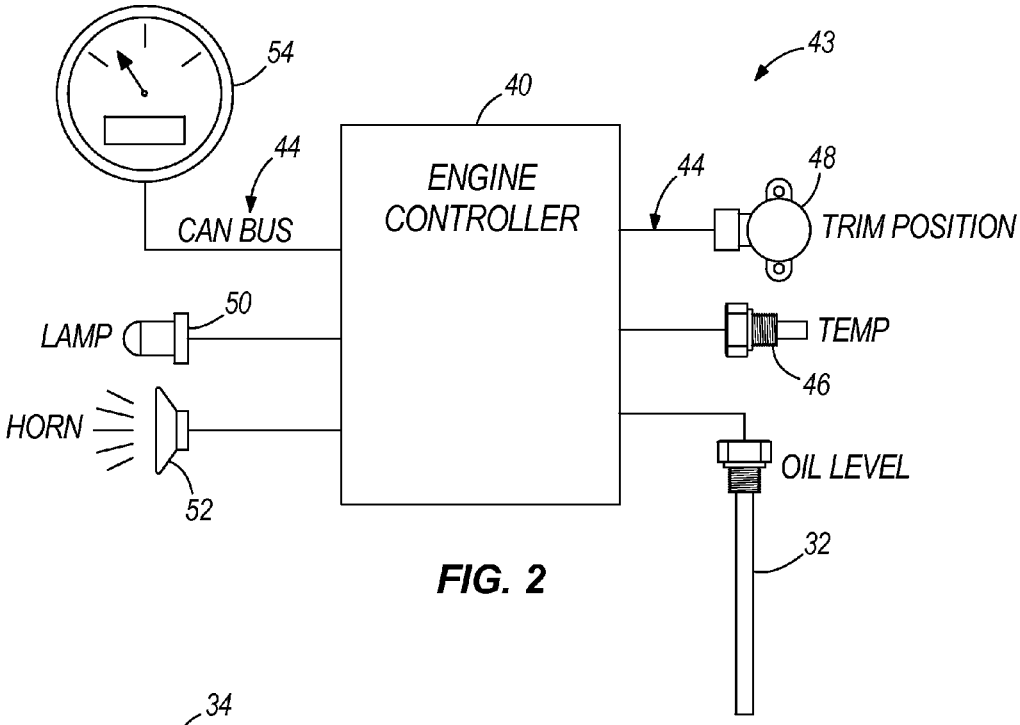
FIG. 2 depicts a system for determining oil level in the outboard motor.
Figure 3:
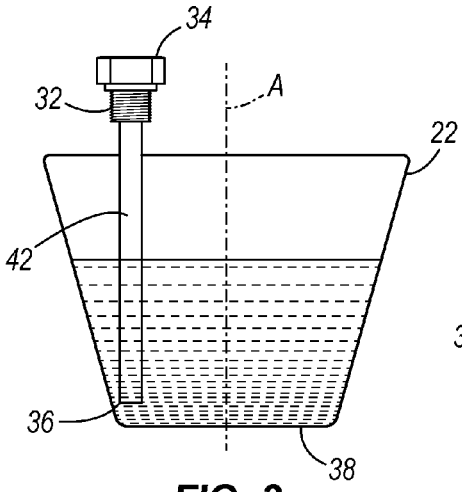
FIG. 3 depicts a sump collecting oil from an internal combustion engine when the outboard motor is at a zero trim position.
Figure 4:
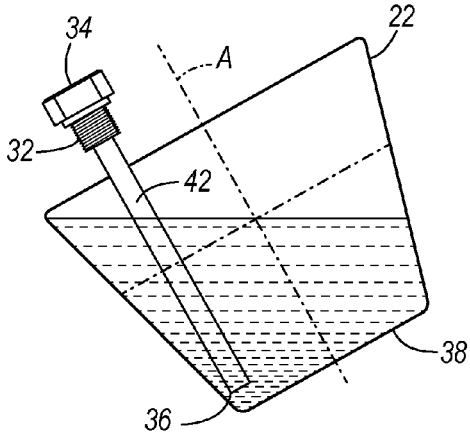
FIG. 4 depicts the sump during a trim condition of the outboard motor when the outboard motor is at a non-zero trim position.

FIGS. 3 and 4 depict the sump 22 at different trim positions of the outboard motor 10. FIG. 3 shows the sump 22 when the outboard motor is at a zero trim position, i.e. when the outboard motor 10 has the trim position shown in FIG. 1 and the internal combustion engine 16 is perpendicular to the waterline 28. FIG. 4 shows the sump 22 when the outboard motor is trimmed upwardly to a non-zero trim position. Also depicted is an electronic oil level sensor 32 extending into the sump 22 for sensing oil level in the sump 22. The oil level sensor 32 has first and second ends 34, 36. The second end 36 of the oil level sensor 32 is disposed in the sump 22 at a location proximate to the bottom 38 of the sump 22. The first end 34 of the oil level sensor 32 extends out of the sump 22. The oil level sensor 32 has an elongated shaft 42 extending between the first end 34 and second end 36. The elongated shaft 42 contains a reactive element for sensing level of oil. The type and configuration of oil level sensor 32 can vary from that shown. In one example, a resistance wire which is designed to cover both the maximum and minimum oil levels is heated by sending a constant current through it. A voltage drop across the wire depends on the amount of heat that is dissipated from the wire to the surrounding medium. Thus, the oil level in the sump 22 can be known as oil conducts the heat better than air. The oil level sensor 32 communicates with an engine controller 40 (see FIG. 2). The voltage drop value is compared in the engine controller 40 to values in a look-up table listing voltage drop versus temperature. This type of oil level sensor is commercially available and manufactured by Siemens VDO. Other types of sensors could be employed such as the prior art sensors having a float, as discussed herein above.

Comparing FIG. 3 and FIG. 4, it can be seen that the oil level that is sensed by the oil level sensor 32 will vary based upon the particular trim position of the outboard motor 10. That is, for a given amount of oil in the sump 22, the oil level that is sensed by the oil level sensor 32 will vary depending upon the particular trim position of the outboard motor 10. In this example, the oil level sensor 32 is shifted leftward of the center axis A of the sump 22. As such, the oil level that is sensed by the oil level sensor 32 in FIG. 3 is less than the oil level that is sensed in the example of FIG. 4. This is a direct result of the difference in trim of the outboard motor 10. If the oil level sensor 32 were shifted rightward of the axis A, the opposite effect would occur. The oil level sensor 32 would detect an oil level that is greater in the example of FIG. 3 compared to the example of FIG. 4. The present inventor has also recognized that these differences in measurements are compounded if the oil level sensor 32 is operated at a time when oil has not completely drained back to the sump 22 from the internal combustion engine 16. This can occur for example while the engine 16 is operating or shortly thereafter.

FIG. 2 depicts a system 43 for determining oil level in the outboard motor 10. The system 43 includes a control circuit or "engine controller" 40 which communicates with and controls various peripheral devices via a controller area network 44. The engine controller 40 can include one or more control modules, each having a memory and a processor for sending and receiving control signals and for communicating with peripheral devices in the controller area network 44. The programming and control operations of the engine controller 40 are described herein with respect to non-limiting examples and/or algorithms. Each of the following examples/algorithms includes a specific series of steps for accomplishing certain system control functions. However, the configuration of the engine controller 40 and any related controllers can vary from that shown and described. The scope of this disclosure is not intended to be literally bound by the literal order and content of steps described herein and thus non-substantial differences and/or changes still fall within the scope of the disclosure.

The noted peripheral devices can include the oil level sensor 32, a temperature sensor 46 for sensing and providing temperature of the internal combustion engine 16 to the engine controller 40, and a trim position sensor 48 for sensing and providing trim position of the outboard motor 10 to the engine controller 40. Visual and/or audio feedback devices such as lamp 50, horn 52, and/or display dial 54 can be provided for providing feedback to the operator regarding one or more characteristics of the oil level in the sump 22, as described further herein below. The system 43 shown is not limiting and more or less feedback devices can be provided, including for example video screens, touch screens and/or the like.

The engine controller 40 is programmed to calculate a characteristic of the oil level in the sump 22 while taking into consideration whether or not oil has drained into the sump 22 from the internal combustion engine 16 and also while taking into consideration the trim position of the outboard motor 10. The characteristic of the oil level can for example be the actual oil level of the sump 22 if the outboard motor 10 were at the zero trim position shown in FIG. 3. Alternately, the characteristic of the oil level can for example be whether the actual oil level of the sump 22, if the outboard motor were at the zero trim position shown in FIG. 3, is above or below a predetermined value or is within a predetermined range of values. In this example, the memory of the engine controller 40 stores a look-up table that correlates the trim position of the outboard motor 10 and the oil level measured by the oil level sensor 32 to an actual oil level of the sump 22 if the outboard motor 10 were at the zero trim position shown in FIG. 3. One having ordinary skill in the art will understand that this correlation can be mathematically calculated based upon the geometry of the sump 22 and the location of the oil sensor 32 within the sump 22. Based upon the look-up table, the engine controller 40 is programmed to calculate the actual oil level in the sump 22 if the outboard motor were at the zero trim position and can be further programmed to compare this value to a predetermined value or range. Although this example correlates the measured oil level to the oil level at a benchmark of zero trim position, other trim positions than zero trim positions could be used.

The engine controller 40 can optionally be configured to calculate the noted characteristic of the oil level only after it determines that the oil has drained from the internal combustion engine 16 into the sump 22. This allows for a more accurate measurement of oil level in the sump 22, by accounting for the oil that was being utilized during operation of the internal combustion engine 16. The engine controller 40 can be programmed to determine whether the oil has drained into the sump 22 based upon a temperature of the internal combustion engine 16 sensed by the temperature sensor 46. Specifically, the engine controller 40 can be programmed to monitor the temperature of the internal combustion engine 16 via the temperature sensor 46 and determine that the oil has drained into the sump 22 when the temperature of the internal combustion engine 16 decreases below a predetermined value. It can be inferred that when the internal combustion engine 16 has not operated for a predetermined period of time (during which the temperature decreased below the predetermined value), the oil has fully drained back into the sump 22. In another example, the engine controller 40 can determine that the oil has drained into the sump 22 when more than a predetermined amount of time has elapsed since the internal combustion engine 16 was last operated. If the system is equipped with global positioning system (GPS) navigation, this step can be determined by the engine controller 40, for example, by a global positioning time stamp. Other methods for determining the time that has elapsed since the internal combustion engine 16 was last operated can be employed, such as for example by use of an internal clock in the engine controller 40.

The engine controller 40 can alert the operator the characteristic of the oil level via one or more of the noted feedback devices. Once the engine controller 40 calculates the characteristic of the oil level in the sump 22, the engine controller 40 can control one or more of the visual displays and/or audio displays to inform the operator of the oil level. The engine controller 40 can compare a characteristic of the oil level, such as the actual oil level, to a predetermined value and inform the operator regarding the comparison. In this example, the predetermined value can be a range of oil levels and the characteristic of the oil level can be the actual oil level if the outboard motor were at a zero trim position.

Figure 5:
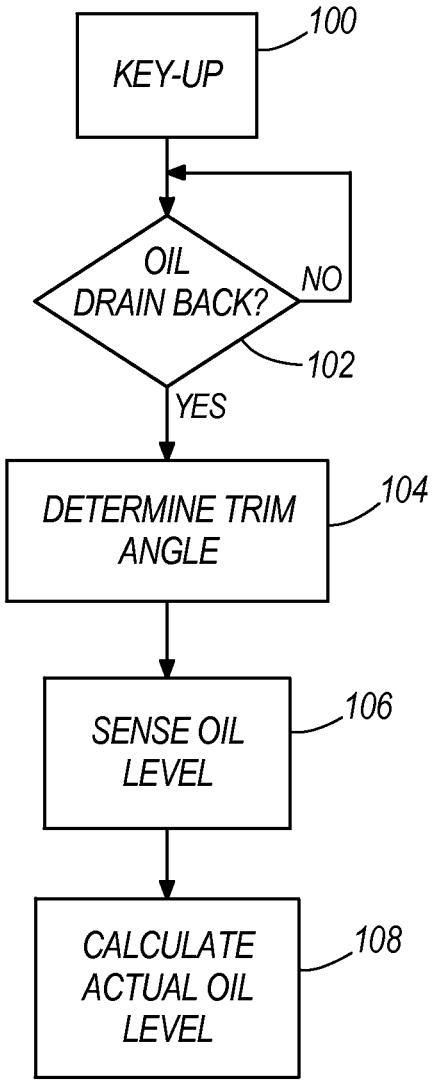
FIG. 5 is a flow chart depicting one example of a method of determining a characteristic of oil level in an outboard motor.

Referring to FIG. 5, one example of a method of determining oil level in an outboard motor 10 is charted. At step 100, the outboard motor 10 is keyed up by the operator. At key-up, the internal combustion engine 16 is not operating; however, the engine controller 40 is powered by a battery and the respective temperature sensor 46 and trim position sensor 48 are operational. At step 102, the engine controller 40 determines whether oil has drained into a sump 22 from the internal combustion engine 16 in the outboard motor 10. As explained above, this can be accomplished by sensing the temperature of the internal combustion engine 16 and/or determining whether a predetermined amount of time has elapsed since the internal combustion 16 was last operated. If no, step 102 is repeated. If yes, at step 104, the engine controller 40 senses a trim position or angle of the outboard motor 10. At step 106, the engine controller 40 senses via the oil level sensor 32 the oil level in the sump 22. At step 108, the engine controller 40 calculates a characteristic of the oil level of the outboard motor 10 based upon the sensed oil level and trim position of the outboard motor 10.

Figure 6:
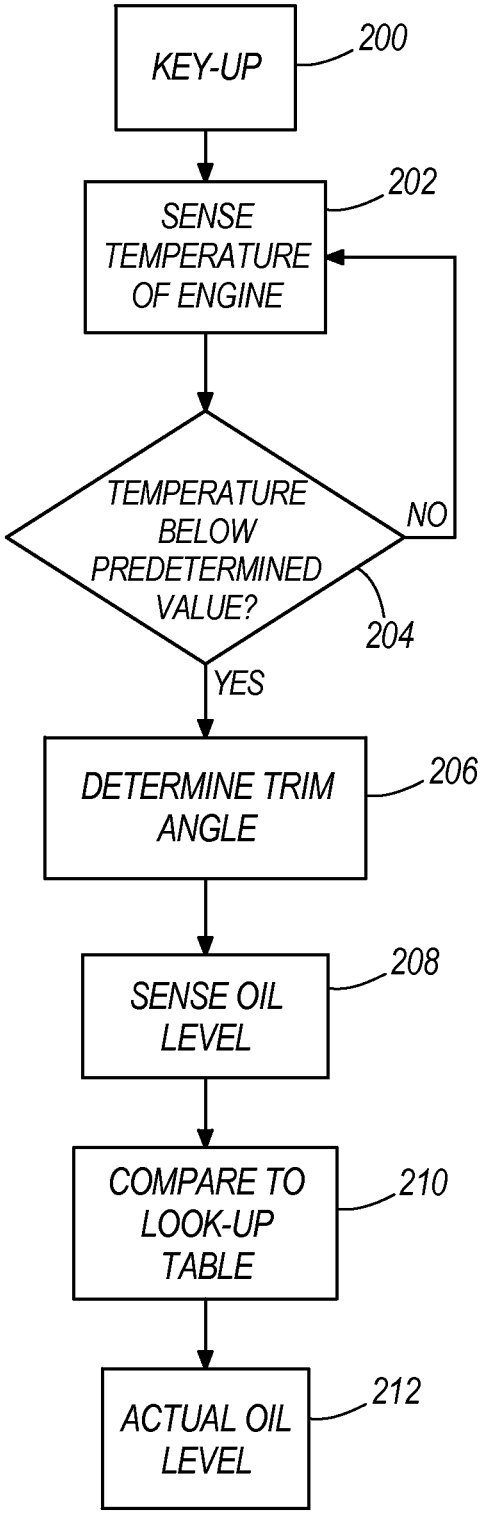
FIG. 6 is a flow chart depicting another example of a method of determining a characteristic of oil level in an outboard motor.

FIG. 6 depicts a chart of another example of a method of determining oil level in an outboard motor. At step 200, the outboard motor 10 is keyed up by the operator. At step 202, the engine controller 40 senses via the temperature sensor 46 a temperature of the internal combustion engine 16. At step 204, the engine controller 40 determines whether the sensed temperature is below a predetermined value. If no, step 202 is repeated. If yes, at step 206, the engine controller 40 determines via the trim position sensor 40 a trim angle of the outboard motor 10. At step 208, the engine controller 40 senses via the oil level sensor 32 an oil level in the sump 22. At step 210, the engine controller 40 compares the sensed oil level to a look-up table correlating trim angle to oil level. At step 212, the engine controller calculates the oil level of the outboard motor based upon the sensed oil level and trim position of the outboard motor.

Further steps to the methods shown in FIGS. 5 and 6 can include operating a feedback device such as the visual displays and/or audio displays discussed herein above to inform an operator of the calculated characteristic of the oil level in the sump 22. In some examples, the engine controller 40 can be configured to compare the characteristic of the oil level to a predetermined value or range and then inform, with the feedback device, the operator regarding whether the characteristic of the oil level is above or below the predetermined value or range.

Thus, as described above, a method for determining oil level in a sump of an outboard motor is provided that includes the steps of determining whether oil has drained back into the sump from an internal combustion engine of the outboard motor and then sensing an oil level in the sump once the oil has drained back into the sump. Further, the method can include determining a trim position of the outboard motor and then operating the control circuit to calculate a characteristic of oil level of the outboard motor based upon the sensed oil level and based upon the trim position, and further indicating the characteristic of the oil level to an operator.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words "means for" together with an associated function.

What is claimed is:

1. A system for determining oil level in an outboard motor, the system comprising an internal combustion engine that drains oil to a sump, a control circuit, and a sensor that senses oil level, in the sump, wherein the control circuit determines whether oil has drained into the sump from the internal combustion engine, determines a trim position of the outboard motor, and then after the oil has drained from the internal combustion engine into the sump, calculates a characteristic of the oil level in the sump based on the trim position;

wherein the control circuit determines that the oil has drained into the sump when more than a predetermined amount of time has elapsed since the internal combustion engine was last operated; and wherein the time elapsed since the internal combustion engine was last operated is determined via a global positioning time stamp.

2. A system according to claim 1, wherein the characteristic of the oil level in the sump comprises the oil level in the sump if the outboard motor were at a zero trim position.

3. A system according to claim 1, comprising a temperature sensor sensing, temperature of the internal combustion engine, wherein the control circuit determines whether the oil has drained into the sump from the internal combustion engine based on the temperature of the internal combustion engine.

4. A system according to claim 3, wherein the control circuit determines that oil has drained into the sump from the internal combustion engine when the temperature of the internal combustion engine decreases below a predetermined value.

5. A system according to claim 1, wherein the control circuit controls a feedback device to inform an operator of the characteristic of the oil level.

6. A system according to claim 5, wherein the feedback device comprises at least one of a visual display and an audio display.

7. A system according to claim 5, wherein the control circuit compares the characteristic of the oil level to a predetermined value and informs the operator regarding the comparison of the characteristic and the predetermined value.

8. A system according to claim 7, wherein the predetermined value comprises a range and the characteristic of the oil level comprises the oil level if the outboard motor were at a zero trim position.

9. A system according to claim 1, comprising a trim sensor sensing the trim position of the outboard motor.

10. A method of determining oil level in an outboard motor, the method comprising determining, with a control circuit, that oil has drained into a sump from an internal combustion engine in the outboard motor; sensing an oil level in the sump once the oil has drained into the sump;

calculating, with the control circuit, a characteristic of the oil level of the outboard motor based upon the sensed oil level and based on a trim position of the outboard motor;

determining, with the control circuit, whether the oil has drained back into the sump based upon an amount of time that has passed since the internal combustion engine was last operated; and determining an amount of time that has passed since the internal combustion engine was last operated via a global positioning time stamp.

11. A method according to claim 10, comprising sensing temperature of the internal combustion engine and determining, with the control circuit, whether the oil has drained into the sump based upon the temperature of the internal combustion engine.

12. A method according to claim 11, comprising determining, with the control circuit, that the oil has drained into the sump when the temperature of the internal combustion engine decreases below a predetermined value.

13. A method according to claim 10, comprising operating, a feedback device with the control circuit to inform an operator of the characteristic of the oil level.

14. A method according to claim 13, comprising comparing, with the control circuit, the characteristic of the oil level to a predetermined value and then informing, with the feedback device, the operator regarding whether the characteristic of the oil level is above or below the predetermined value.

15. A method according to claim 10, comprising sensing the trim position of the outboard motor.

* * * * *